US006726442B2

(12) United States Patent
Letourneau

(10) Patent No.: US 6,726,442 B2
(45) Date of Patent: Apr. 27, 2004

(54) DISC TURBINE INLET TO ASSIST SELF-STARTING

(76) Inventor: Guy Louis Letourneau, 33470 Chinook Plz., Warren, OR (US) 97056

( * ) Notice: Subject to any disclaimer, the term of this patent is extended or adjusted under 35 U.S.C. 154(b) by 53 days.

(21) Appl. No.: 10/074,464

(22) Filed: Feb. 11, 2002

(65) Prior Publication Data

US 2002/0150466 A1 Oct. 17, 2002

Related U.S. Application Data

(60) Provisional application No. 60/268,630, filed on Feb. 14, 2001.

(51) Int. Cl.[7] ..... F01D 1/36

(52) U.S. Cl. ..... 415/90; 415/203; 415/228; 416/4

(58) Field of Search ..... 415/76, 90, 198.1, 415/203, 206, 207, 224, 228; 416/4

(56) References Cited

U.S. PATENT DOCUMENTS 4,201,512 A * 5/1980 Marynowski et al. ..... 415/90

* cited by examiner

*Primary Examiner*—Edward K. Look
*Assistant Examiner*—Dwayne J. White

(57) ABSTRACT

A disc turbine inlet collects working fluid, introduces it into the rotor housing at a defined location and imparted at a defined injection angle with respect to the tangential motion of the discs in rotary motion. An injection angle within the optimum range delineated by this invention enables the working fluid to entrain stationary or slowly rotating discs into motion. The inlet design combines smooth sectional transitions and arcuate directional changes to minimize frictional losses. The inlet has a nozzle section which locates precisely into a receiving aperture of the turbine rotor housing.

14 Claims, 5 Drawing Sheets

Section A-A

Section B-B

Section C-C

View D-D

DISC TURBINE INLET TO ASSIST SELF-STARTING

CROSS REFERENCE TO RELATED APPLICATIONS

This application claims the benefit of U.S. Provisional Application No. 60/268,630, filed Feb. 14, 2001.

BACKGROUND OF THE INVENTION

1. Field of the Invention

This invention relates to inlet geometry for introducing working fluid into a turbine whose rotor is comprised of spaced apart discs. The inlet geometry directs the fluid in a manner which allows the turbine to accelerate to operating speed from standstill or from very low initial velocities.

2. Description of the Related Art

Turbines comprised of spaced-apart rotor discs were first described by Nikola Tesla in U.S. Pat. No. 1,061,142 and 1,061,206. For this reason, these turbines are sometimes referred to as Tesla Turbines, but are alternatively known as Prandtl layer turbines, boundary layer turbines, cohesion-type turbines, and bladeless turbines.

The turbine rotor consists of a stack of discs spaced apart and fixed to a rotatable shaft. The rotor assembly is contained in a housing closely fitted to the perimeter of the discs. The discs have vents near the center, and the housing includes at least one outlet near the center. In operation, an energetic working fluid at pressure and temperature is introduced at the periphery of the disc stack and contained in a housing which closely follows the perimeter of the discs. The working fluid passes between the discs and exits the stack assembly through vents near the center, leaving the housing through its outlets.

As the fluid enters the spaces between the discs, it exchanges a portion of its momentum to them through viscous adhesion of the fluid to the surfaces of the disc. Since the discs are constrained to rotate about the axis of the shaft, the motion attained by extraction of momentum of the fluid is axial rotation. The axial rotation of the discs in turn drags the fluid in a tangential direction, effecting a spiral flow of the working fluid.

The tangential component of the flow creates centripetal force within the working fluid, which must be overcome by additional fluid entering the housing. Therefore, in the steady state, great back pressure is developed at the inlet of the machine, along with a significant drop in pressure between the inlet and the outlet of the machine. This drop in pressure, with its concomitant drop in temperature and expansion of the working fluid, efficiently extracts much of the available thermodynamic energy of the working fluid.

The prior art devices introduce the working fluid at the rim of the discs in a tangential direction. Two examples of this design are given in FIGS. 1A and 2A and their enlargements in FIGS. 1B and 2B. It fact, the ability of working fluid to accelerate stationary or slow moving discs depends on the injection angle, which is the angle formed between the direction of the entering working fluid and a tangent to the disc periphery at a point intersected by the direction of the entering fluid.

Prior art inlets also include deleterious features such as sharp transitions along the internal passage, and features which abruptly alter the direction of fluid flow immediately prior to its entry into the disc rotor housing. Such sharp transitions create undesired turbulence in the working fluid and frictional losses which reduce the overall efficiency of the turbine. Enlargement FIG. 1B especially illustrates an inlet design inhering both abrupt sectional changes and an abrupt directional change of the internal passage through which working fluid is admitted.

A further limitation of the prior art is that the devices are not reliably self-starting; typically the shaft and the discs coupled to it must be in motion before the working fluid is able to accelerate the turbine to its steady-state operation. Typically the initial rotational speed of the turbine must be significant, for example on the order of at least one-tenth of the steady-state operating speed. The prior art devices therefore rely on external energy sources and motive means to provide initial rotation of the discs. These external means detrimentally add expense, size, weight, and mechanical complexity to a disc turbine system.

The benefit secured by a self-starting design is the elimination of the auxiliary components required in a system dependent on initial rotational speed for acceleration to operating speed. The benefit gained by a nearly self-starting design is the significant reduction of power output demanded or service hours required of these auxiliary components, and a concomitant reduction in expense, size, and weight of this auxiliary system.

It is therefore advantageous to provide a means of directing the influx of working fluid so that the passage of the fluid between stationary or nearly stationary discs of the rotor assembly is sufficient to accelerate the rotor assembly to operating speed.

SUMMARY OF THE INVENTION

According to the present invention, an inlet for a disc turbine is optimally placed on a housing for a disc turbine, and the direction of entering fluid as imparted by the geometry of the inlet is optimally aimed at a predetermined injection angle, so as to afford self-starting of a stationary set of rotor discs and swift acceleration of a disc rotor assembly already in motion.

Accordingly, Several Objects of the Invention Exist

An object of the invention is to provide the design parameters by which an inlet component of a spaced-disc turbine may be formed, so that working fluid directed through this inlet will accelerate a stationary or nearly stationary rotor assembly up to operating speed.

Another object of the invention is to precisely locate the inlet and its nozzle onto the rotor housing so that the ingress direction of the working fluid conforms to a desired injection angle as defined and explained further.

In this regard, a further object of the invention is to effect a seal of the inlet onto the housing so as to eliminate the escape of working fluids, which would otherwise present an operating hazard or a loss of inlet pressure.

A yet further object of this invention is to collect and concentrate the working fluid in a manner which reduces turbulent or frictional losses, by eliminating abrupt or sharp sectional changes of the inner surfaces of the turbine inlet, and to provide smooth sectional changes instead.

Yet another object of this invention is to reduce turbulent or frictional losses by eliminating abrupt changes in direction of the working fluid, and to provide smooth and especially arcuate directional changes instead.

An additional object of this invention is to impart stability and robustness to the reducing section of the inlet body so as to robustly resist torques and bending moments applied during connection of the assembled inlet to a fluid supply pipe.

The inlet may be an integral portion of a housing, such as a cast housing which includes an inlet section, or the inlet may be a discrete component which is affixed to the housing by attachment means. In this latter case, registration of the inlet to the housing is required during assembly, so that said assembly process located, aligns, and positions the nozzle orifice at its desired injection angle relative to the rotary motion of the discs.

For an inlet which is a discrete component from the housing, leakage of working fluid from between the inlet and housing must be eliminated, and therefore it is advantageous for the inlet to provide one or more contoured or planar surfaces which closely match accepting surfaces on the housing, so as to effect a fluid seal at their faces.

This seal may be effected by means of caulking or gasket material deposed between the sealing faces, or simply by sufficient mechanical compression of the inlet faces against the housing faces. More specifically, the sealing faces of the inlet may be in the form of a flange which mates against a complimentary surface on the housing.

DRAWINGS

DESCRIPTION

In this application, the injection angle is the angle formed between the direction of the entering working fluid and a tangent to the disc periphery at a point intersected by the direction of the entering fluid. This injection angle has an optimum range within which stationary discs of the turbine rotor may be entrained into motion, and discs in motion at speeds below operational speed may be accelerated to operational speed.

Figure 1A:
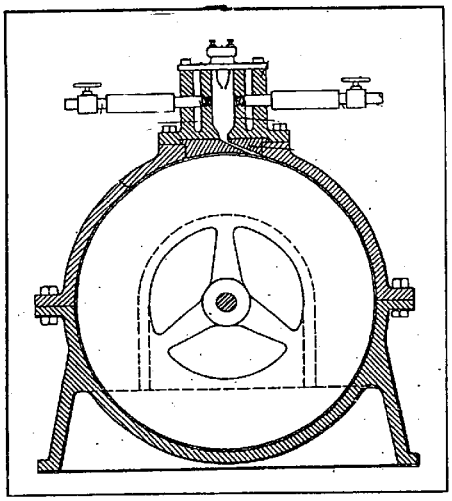
PRIOR ART Fig. 1A
FIG. 1A is a sectional view through a prior art inlet and associated disc turbine.
Figure 1B:
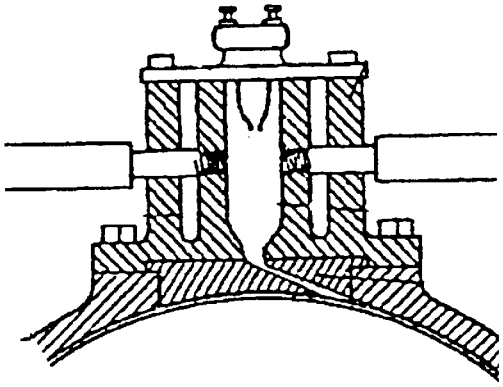
PRIOR ART Fig. 1B
FIG. 1B is an enlarged view of the inlet of FIG. 1A.
Figure 2A:
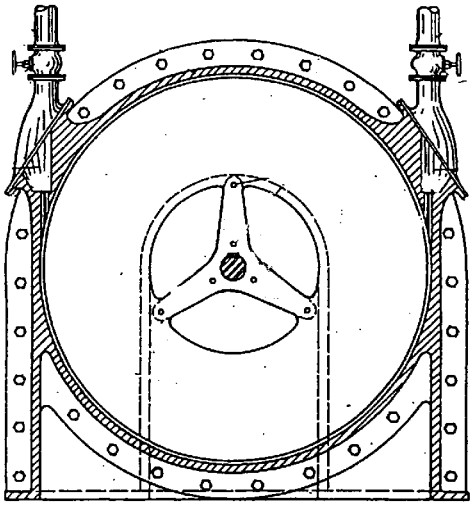
PRIOR ART Fig. 2A
FIG. 2A is a sectional view of an alternative prior art inlet and associated disc turbine.
Figure 2B:
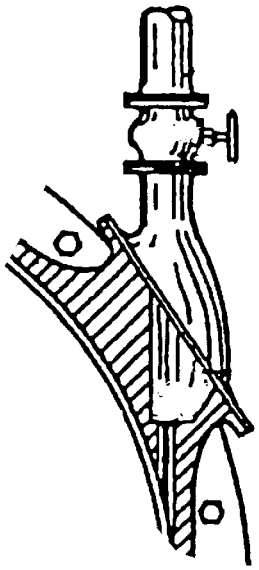
PRIOR ART Fig. 2B
FIG. 2B is an enlarged view of the right inlet of FIG. 2A.
Figure 3:
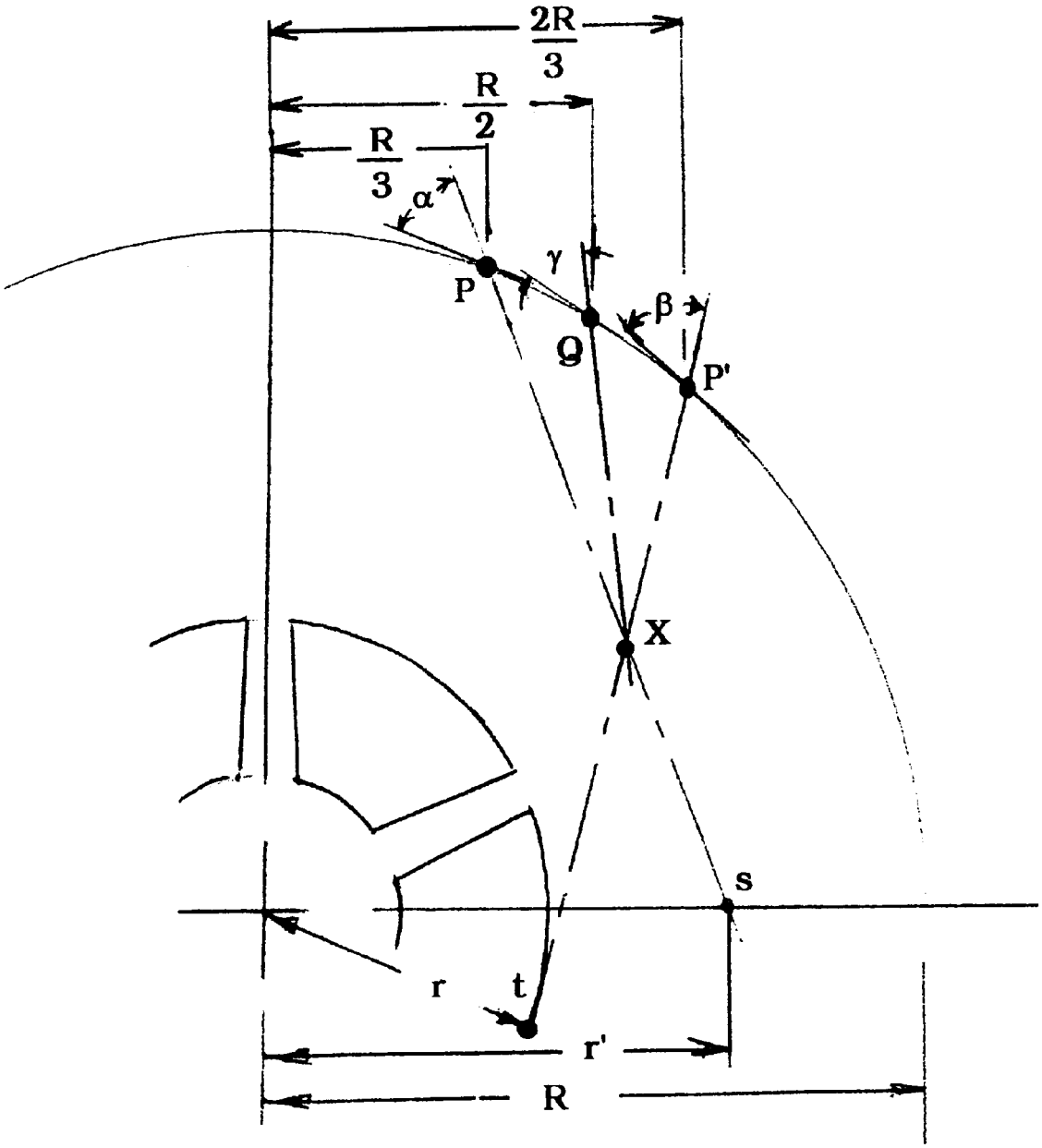
FIG. 3 is a graphical representation of inlet location, range and direction in accordance with the present invention.

Referring to FIG. 3, the preferred inlet location and the range of an inlet injection angle may be defined by the geometry of the rotor design. Beginning with arbitrarily located ordinate and abscissa as axes intersecting the center of a rotor disc, the parameters used to arrive at the optimum location and injection angle are as follows:

| Reference Item: | Description of Reference Item: |
|---|---|
| P: | Point on disc rim intersecting a line R/3 distant from and parallel to the ordinate |
| P': | Point on disc rim intersecting a line 2R/3 distant from and parallel to the ordinate |
| Q: | Point on disc rim intersecting a line R/2 distant from and parallel to the ordinate |
| r: | Radius of disc vent opening |
| r': | Midpoint value (mean) of r and R |
| R: | Radius of disc rim |
| s: | Point on the abscissa a distance r' from the ordinate |
| t: | tangent point on radius r through point P' |
| X: | Intersection of lines Ps and P't |
| $\alpha$: | injection angle between line Ps and rim tangent at P |
| $\beta$: | injection angle between line P't and rim tangent at P' |
| $\chi$: | injection angle between line QX and rim tangent at Q |

The minimum injection angle for an inlet of the self-starting design described by this invention is $\alpha$, because introducing fluid in any more of a tangential direction would fail to introduce the entire stream into the active surfaces of the discs. In such a situation, at least some of the fluid would be disadvantageously introduced into the gap between the periphery of the disks and the inner surface of the housing. Momentum of this fluid would not substantially transfer to the rotor discs.

The maximum injection angle for an inlet of the self-starting design described by this invention is $\beta$, which is a line of introduction tangent to the rims of the disc vents at a point t. It is seen that introducing a working fluid stream at an greater than $\beta$ disadvantageously aims the working fluid to escape directly out the vents without substantially transferring momentum to the discs. Also, an excessively large injection angle aims the force of the working fluid more directly at the rotor shaft, applying a non-productive bending load to the rotor assembly rather than a tangential force useful in accelerating stationary or slow-moving discs up to operating speed.

An intermediate embodiment within the scope of this invention includes an inlet injection angle $\chi$, which is defined by a line through two intermediate points: the first point being the intersection at point X of the lines of direction of fluid flow of the minimum and maximum injection angles as described above, and a point Q defined as one-half of the outer radius of the disc.

One may now proceed to address a further design objective of the preferred embodiment: the smooth sectional transitions and arcuate directional changes which minimize frictional losses within the inlet.

Figure 4:
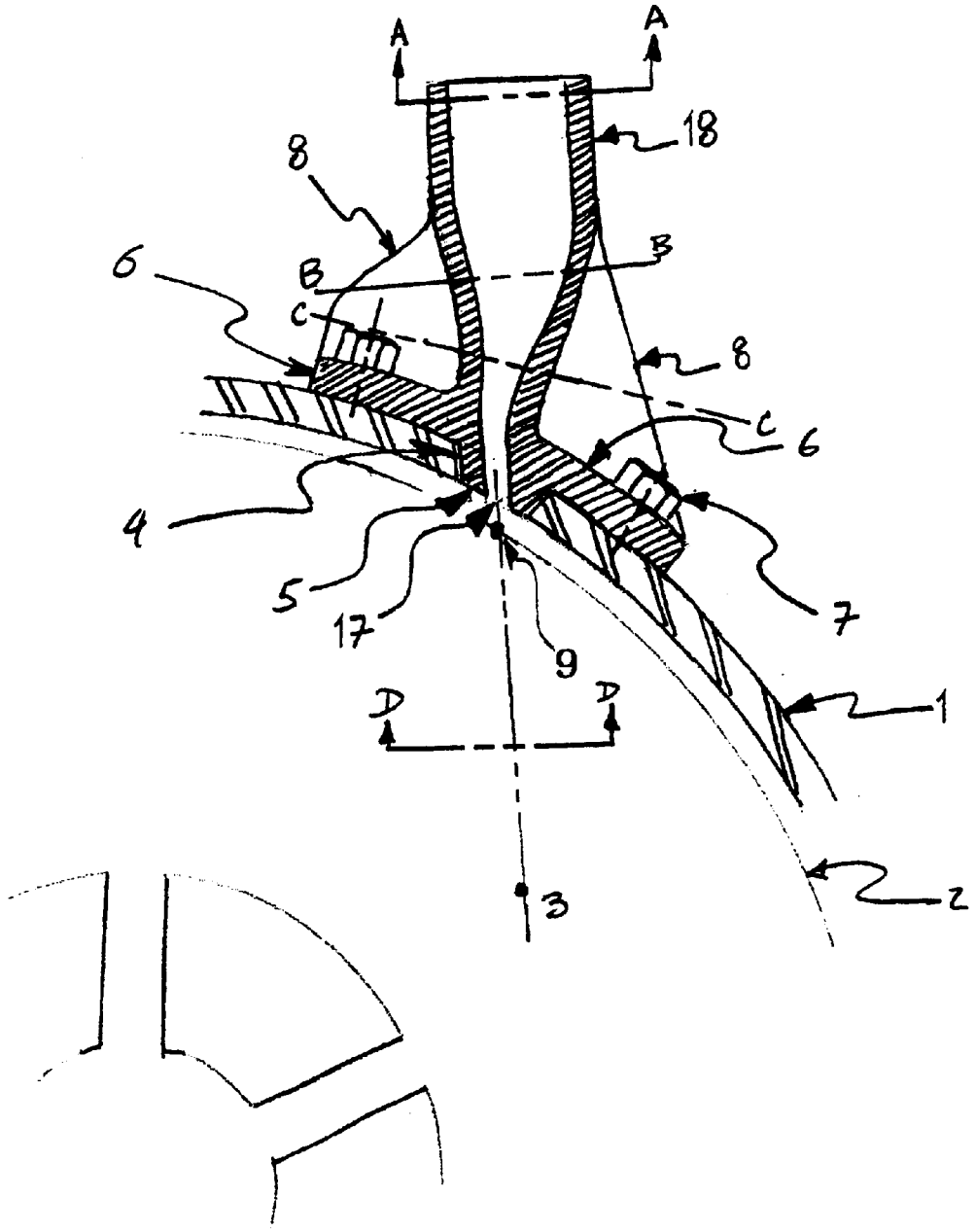
FIG. 4 is a fragmentary sectional view through an inlet body and associated disc turbine in accordance with the present invention.

FIG. 4 illustrates a cross sectional view through an inlet of this invention. The section plane is coplanar to a disc surface and normal to the rotor axis. The turbine rotor housing [1] surrounds a stacked series of rotor discs [2]. The inlet body [18] transects a flange [6] whose contour matches the exterior contour of the turbine rotor housing [1]. The housing includes a receiving aperture [4] which accepts the nozzle portion of the inlet [5]. Furthermore, the receiving aperture [4] of the housing and the nozzle portion of the inlet [5] are closely matched to afford precise location of the nozzle and to minimize leakage of the working fluid.

This embodiment of the inlet is fastened to the turbine rotor housing by a plurality of bolts [7]. However, any other sort of fasteners may be used as well. Additionally, the inlet may be permanently fastened by welding or by an adhesive process.

Point X, as determined by the geometry and derived as explained above, is identified by item [3] and point Q is identified by item [9]. In this figure the line QX appears nearly vertical. However, this is not a necessary outcome of the geometrical procedure used to establish line QX.

Where the inlet provides a sealing flange, the portion of the inlet body extending away from the flange [6] would be a fragile feature, especially if the inlet is made by injection molding or casting; so at least one rib [8] is provided to stabilize this feature with respect to the flange and provide strength during assembly and connection of the turbine to its supply.

FIG. 4 also illustrates the smooth transition of the inner passage of the inlet between four section shapes, and also illustrates that the inner walls throughout these transition sections accelerate and concentrate the flow of the working fluid. Three sections A—A, B—B, and C—C, and one end view D—D of this inner passage are identified in FIG. 4 and individually illustrated in FIGS. 5A through 5D.

Figure 5A:
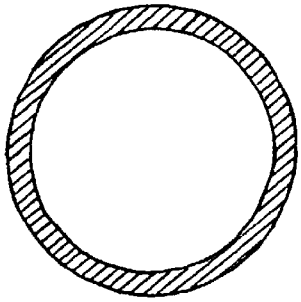
FIGS. 5A through 5D are a series of transition sectional views taken along the inlet of FIG. 4.
Figure 5B:
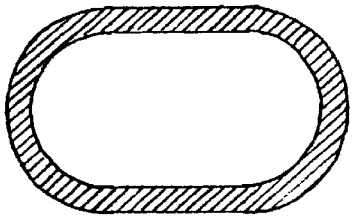
Figure 5C:
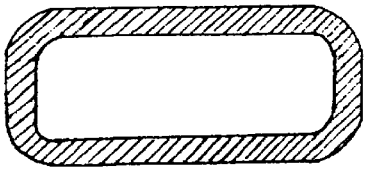
Figure 5D:
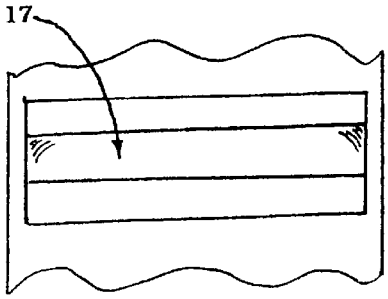

FIG. 5A shows a circular section. FIG. 5B shows a lozenge section. FIG. 5C shows a rectangular section with round filleted corners. FIG. 5D is an end view showing the inlet nozzle orifice [17] as a rectangular opening where the working fluid is admitted into the turbine housing.

The salient features of these transition sections eliminate loss-inducing features such re-entrant angles and sharp edges. The progression of transitions described above eliminates said loss-inducing features by interposing concave or convex features between any planar surface within the inlet passage. Most important, the shapes and sequence of the transition sections join all internal edges of planar surfaces to concave or convex surfaces at tangency, which eliminates aforementioned loss-inducing edges and abrupt changes in fluid direction.

Figure 6:
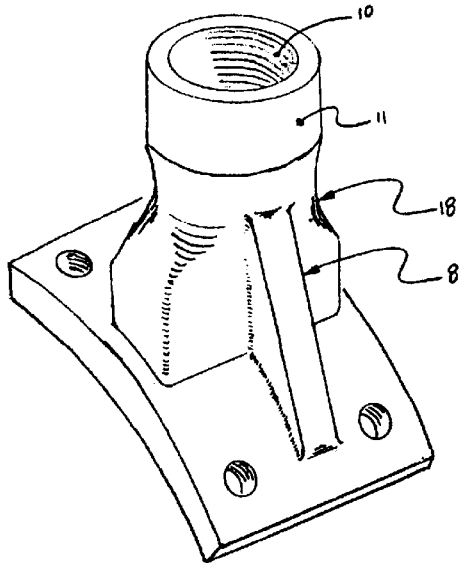
FIG. 6 is an exterior perspective view of one embodiment of an inlet in accordance with the present invention.

FIG. 6 shows an oblique view of the inlet body, with at least one strengthening rib [8] visible. The upstream portion of the inlet body [18] affords an internal surface [10] and an external surface [11] into which standardized mating surfaces, such as pipe threads or bores for compression fittings, are machined.

It is understood that any number of strengthening [8] ribs may originate from the periphery of the inlet body [18], extending to the flange [6], including the number zero in the case of an especially short inlet and sufficiently thick and sufficiently strong material.

Figure 7:
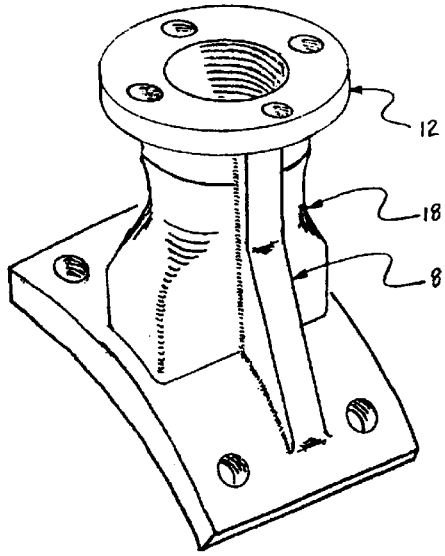
FIG. 7 is an exterior perspective view of an alternative embodiment of an inlet incorporating an attachment flange in accordance with the present invention.

FIG. 7 shows an alternative embodiment in which the attachment affordance is a flange fitting [12] of a known industrial standard, such as an ANSI standard pipe flange. In this embodiment, at least one strengthening rib [8] may extend to bolster the flange fitting [12] as well.

Figure 8:
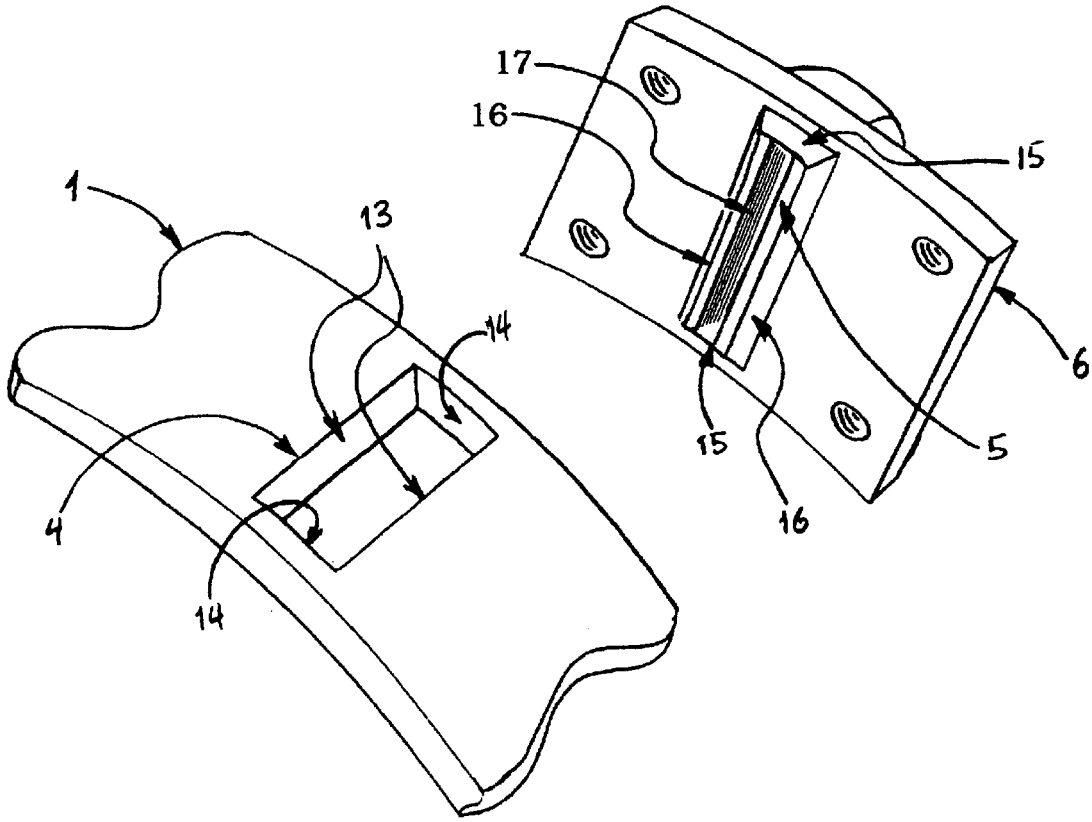
FIG. 8 is a partial perspective view of the inlet and housing of FIG. 4 prior to assembly.

One may now examine the features which properly and precisely locate the inlet body into a receiving aperture of the turbine inlet housing. FIG. 8 illustrates a section of the turbine rotor housing [1] with a receiving aperture [4]. In this invention the aperture is rectangular, with its major axis parallel to the rotary axis of the disc rotor, affording a nearly equal axial distribution of the working fluid among the series of spaces between the discs. However, it is understood that other inlet aperture shapes may be applied in cases where it is desired to direct more fluid into at least one designated zone consisting of at least one inter-disc space, and less fluid in the remaining inter-disc spaces.

The rectangular opening of the preferred embodiment of the rotor housing is described by two longer, longitudinal walls [13] and two shorter, transverse walls [14] athwart the rotary axis of the disc rotor. Continuing with the preferred embodiment, the mating surface of the inlet flange [6] presents a rectangular nozzle section [5] consisting of two shorter, transverse walls [15] and two longer, longitudinal walls [16].

Although it is possible to maintain the facing pairs of wall openings [13,13] and [14,14] parallel with each other, it is preferred that these walls describe an included angle which facilitates assembly and enforces precise and centralizing alignment of the nozzle section [5] as received by the rotor housing aperture [4].

Although it is possible to maintain the opposite pairs of nozzle walls [15,15] and [16,16] parallel with to other, it is preferred that these walls converge at an included angle which facilitates assembly and enforces precise and centralizing alignment of the nozzle section [5] as received by the rotor housing aperture [4].

In the assembly of the preferred embodiment, the longitudinal walls [13] of the turbine rotor housing receiving aperture [4] receive, centralize and align longitudinal walls [16] of the inlet nozzle [5], while transverse walls [14] of said opening receive, centralize and align transverse walls [15] of said nozzle section [5].

Simultaneously effected thereby are: precise location and alignment of the inlet nozzle to the disc rotor housing, controlled ingress of the working fluid at a determined injection angle relative to the tangential motion of the disc surfaces upon which said fluid imparts momentum, and effective sealing of the nozzle to the housing so as to eliminate leakage or power loss.

Said sealing may occur at the interface of the aforementioned locating features of the inlet and housing, and may also be effected between the mating face of a flange on the inlet against a mating surface of the rotor housing.

Although the description above contains many specificities, these should not be construed as limiting the scope of the invention, but as merely illustrative of the most preferred embodiments. For example, a turbine housing may have one or more inlet openings, and these may be shaped other than rectangularly, such as a lozenge, an ellipse, a circle, or an escutcheon as well. Furthermore, the sequence of transition sections along the inlet interior may consist of more or fewer sections, and include other shapes besides circles, lozenges, and round-cornered rectangles consistent with the design goal of interposing concave or convex sections at tangency between any interior planar sections. For example, sections including elliptical, parabolic, and hyperbolic geometry may be utilized as well.

In addition, although the illustrations depict an integrally formed part such as a casting or injection molding, a fabricated assembly inhering the features described is also within the scope of this invention. Thus the scope of the invention should be determined by the appended claims and their legal equivalents, rather than by the examples given.

Reference Numerals

1. Turbine rotor housing
2. Turbine rotor disc
3. Geometrically determined point 'X'
4. Inlet nozzle receiving aperture in turbine housing
5. Nozzle section of inlet
6. Flange
7. Fastening bolts
8. Strengthening rib
9. Geometrically determined point 'Q'
10. Inlet inner surface
11. Inlet outer surface
12. Standard pipe flange attachment
13. Turbine rotor housing opening, longitudinal wall
14. Turbine rotor housing opening, transverse wall
15. Inlet nozzle, transverse wall
16. Inlet nozzle, longitudinal wall
17. Inlet nozzle orifice
18. Inlet body

What is claimed is:

1. A self-starting disc turbine comprising:

a housing defining an interior space; a rotatable shaft passing through said housing and having an axis of rotation; a plurality of rotor discs mounted to said shaft for concentric rotation therewith, each said rotor disc having a circumference with a radius R generally perpendicular to said axis of rotation and defining a plurality of vents, said vents being contoured with a maximum distance r extending from the axis of rotation; and an inlet nozzle orifice that directs a working fluid into said housing generally parallel to said discs and at an angle of injection relative to the circumference of said rotor discs, wherein said angle of injection is selected from a range of angles between a minimum angle of injection $\alpha$ and a maximum angle of injection $\beta$ so that said working fluid accelerates a rotational speed of said plurality of rotor discs, wherein:

said minimum angle of injection $\alpha$ is measured between a tangent to the disc circumference at a point P and a line Ps connecting said point P with a point s on an abscissa passing through said axis of rotation, where said point P is an intersection point of said disc circumference and an ordinate perpendicular to said abscissa spaced R/3 along said abscissa from said axis of rotation, and said point s is spaced a distance (r+R)/2 from said axis of rotation, and said maximum angle of injection $\beta$ is measured between a tangent to the disc circumference at a point P' and a line P't tangent to a circle of radius r concentric with axis of rotation, where said point P' is an intersection point of said disc circumference and an ordinate perpendicular to said abscissa spaced 2R/3 along said abscissa from said axis of rotation, and point t is a tangent point of P't on radius r.

2. The disc turbine of claim 1, wherein said angle of injection is an optimum angle of injection $\chi$ measured between a tangent to the circumference at a point Q and a line QX where said point Q is an intersection point of said disc circumference and an ordinate perpendicular to an abscissa through said axis of rotation, said ordinate spaced R/2 along said abscissa from said axis of rotation; point X is the intersection of two lines Ps and P't, where point P is an intersection point of said disc circumference and an ordinate perpendicular to said abscissa spaced R/3 along said abscissa from said axis of rotation, point s is on said abscissa spaced a distance (r+R)/2 from said axis of rotation, paint P' is an intersection point of said disc circumference and an ordinate perpendicular to said abscissa spaced 2R/3 along said abscissa from said axis of rotation, and tangent point t on an circle of radius r concentric with axis of rotation, and point t is a tangent point of P't on radius r.

3. The disc turbine of claim 1, wherein said housing defines a receiving aperture having locating and aligning features and said inlet body comprises a nozzle end having complementary locating and aligning features, said receiving aperture configured to receive said nozzle end whereby said nozzle orifice is fixed at said angle of injection.

4. The disc turbine of claim 3, wherein said receiving aperture is substantially rectangular with a pair of longitudinal walls and parallel transverse walls shorter than said longitudinal walls and said locating and aligning features comprise arranging said longitudinal walls to converge at an included angle.

5. The disc turbine of claim 1, comprising:

an inlet body defining an internal passage extending from an inlet end to said nozzle orifice, said internal passage delivering said working fluid to said nozzle orifice; a conduit for delivering said working fluid to said inlet body; and attachment means for sealingly attaching said conduit to said inlet body.

6. The disc turbine of claim 5, wherein said attachment means are selected from the group consisting of internal threads, external threads, a compression fitting and a flange.

7. The disc turbine of claim 5, wherein said inlet body comprises a flange having a mating surface contoured to closely match an exterior surface of said housing.

8. The disc turbine of claim 7, wherein said inlet body comprises at least one strengthening rib connecting said inlet body to said flange.

9. The disc turbine of claim 5, wherein said internal passage comprises a substantially smooth internal surface extending from said inlet end to said nozzle.

10. The disc turbine of claim 9, wherein said internal passage has a sectional configuration defined by said internal surface, said sectional configuration being a circle at said inlet end and smoothly transitioning from said circle through a lozenge and a rounded rectangle to a rectangle at said nozzle orifice.

11. A method of determining the most efficient range for an angle of injection of a working fluid into a self-starting disc turbine rotor assembly comprising a plurality of substantially parallel closely spaced discs having a common axis of rotation, each said disc having a substantially identical circular radial configuration including a circumferential rim spaced a radius R from said axis of rotation and defining a plurality of vent openings where said vent openings extend radially inwardly from a maximum vent radius r from said axis of rotation said method comprising the steps of:

assigning a coordinate system centered on said axis of rotation, said coordinate system comprising an ordinate and an abscissa;

locating an advanced inlet point P at the intersection of said rim and a first line parallel to said ordinate and spaced from said ordinate by a distance equal to one-third of the outer radius of said disc (R/3);

locating an retarded inlet point P' at the intersection of said rim and an second line parallel to said ordinate and spaced from said ordinate by a distance equal to two-thirds of outer radius of said disc (2R/3);

calculating a radius r' by taking the arithmetic mean of the rim radius R and the maximum vent radius r and locating a point s on said abscissa at a distance equal to radius r';

drawing a line Ps passing through said points P and s;

drawing a line P't tangent to radius r at a point t and passing through point P';

measuring a minimum injection angle $\alpha$, between a tangent to said rim at point P and the line Ps;

measuring a maximum injection angle $\beta$, between a tangent to said rim at point P' and the line P't;

expressing the result of this process as a solution set including an advanced inlet point P, a retarded inlet point P', and a range of possible injection angles between said minimum injection angle $\alpha$ and said maximum injection angle $\beta$;

wherein injection of a working fluid at an angle of injection selected from said range of possible injection angles reliably accelerates a rotational speed of a stationary or nearly stationary rotor assembly.

12. The method of claim 11, further comprising the steps of:

locating an optimum inlet point Q at the intersection of said rim and a line parallel to the ordinate and spaced from said ordinate a distance equal to one-half of outer radius of the disc (R/2);

locating an intersection point X of the lines Ps and P't;

drawing a line QX passing through said points Q and X;

measuring an optimum injection angle $\chi$ between a tangent to the rim at point Q and the line QX; and expressing the result of this process as a solution set including an optimum inlet point Q and an optimum injection angle $\chi$.

13. A disc turbine comprising an inlet nozzle that directs working fluid into the disc turbine rotor assembly at an optimum angle of injection $\chi$ calculated according to the method of claim 12.

14. A disc turbine comprising an inlet nozzle that directs working fluid into the disc turbine rotor assembly at an angle of injection between the minimum angle of injection $\alpha$ and the maximum angle of injection $\beta$ calculated according to the method of claim 11.

* * * * *